United States Patent [19]

Beard et al.

[11] 4,383,538

[45] May 17, 1983

[54] APPARATUS FOR MOISTURE AND HEAT CONDITIONING COMPACTED TOBACCO MASS

[75] Inventors: Hoyt S. Beard; Daniel G. Williard, both of Winston-Salem; Marvin G. Woempner, Thomasville, all of N.C.

[73] Assignee: R. J. Reynolds Tobacco Company, Winston-Salem, N.C.

[21] Appl. No.: 252,989

[22] Filed: Apr. 10, 1981

[51] Int. Cl.[3] ..... A24B 3/02; A24B 3/12

[52] U.S. Cl. ..... 131/300; 131/301; 131/302; 131/304; 131/306

[58] Field of Search ..... 131/300, 301, 302, 303, 131/304, 306

[56] References Cited

U.S. PATENT DOCUMENTS

| | | | |
|---|---|---|---|
| 2,587,771 | 3/1952 | Shoenbaum et al. | 131/300 X |
| 2,864,381 | 12/1958 | Rowell | 131/301 |
| 3,345,992 | 10/1967 | Lederman et al. | 131/301 |
| 3,372,703 | 3/1968 | Conard | 131/300 |
| 3,838,698 | 10/1974 | Dickinson | 131/304 |

FOREIGN PATENT DOCUMENTS

| | | | |
|---|---|---|---|
| 1328545 | 9/1970 | U.S.S.R. | 131/300 |
| 2364434 | 1/1978 | U.S.S.R. | 131/300 |

*Primary Examiner*—V. Millin

*Attorney, Agent, or Firm*—Grover M. Myers

[57] ABSTRACT

Dry, compacted masses of tobacco are conditioned by inserting an array of parallel perforated probes into the mass and passing high pressure steam through the probes and probe perforations into the tobacco mass as the probes are inserted and withdrawn. The conditioning apparatus includes a frame supporting a probe array and a ram for moving the array toward and away from a tobacco mass supported by a conveyor. The probes are flexibly mounted to prevent bending, and extend through a stripper plate which is supported from the array by way of a latching mechanism. The stripper plate holds the tobacco mass in place to prevent lifting of the mass upon withdrawal of the probes.

18 Claims, 11 Drawing Figures

APPARATUS FOR MOISTURE AND HEAT CONDITIONING COMPACTED TOBACCO MASS

BACKGROUND OF THE INVENTION

The present invention relates, in general to the field of conditioning dry, compacted masses of tobacco and, more particularly, to an apparatus and a method for restoring moisture and flexibility to tobacco.

As is well known in the art, raw tobacco is often stored and shipped in dry, compacted masses, either as bales, which are generally rectangular cross-section, or in hogsheads, which are of generally circular cross-section. Although compacting of the tobacco provides convenient and efficient storage and shipping, it makes the tobacco difficult to handle in the manufacturing process, for the tobacco leaves become brittle and readily degrade into fine particles when the bales or hogsheads are opened. For manufacturing purposes, it is necessary to separate the leaves, and to do this, it is necessary to restore moisture and flexibility to the compacted tobacco masses. Such conditioning of the tobacco is accomplished in the prior art by exposure of the tobacco to a conditioning agent, which is normally steam.

A variety of systems have been devised for conditioning tobacco, and in general five parameters determine the usefulness and desirability of such a system. First, a viable system must provide a high volume operation in order to keep pace with other production equipment. Second, the system should be as economical as possible in terms of the cost of both equipment acquisition and operation. Third, the system should consume as little steam as possible, in order to minimize the energy expenditure required to condition a given volume of tobacco. Fourth, a viable system should produce as little particulate tobacco dust (fines) as possible so as to maintain a healthy working environment. Finally, the tobacco must be conditioned uniformly to prevent the formation of pads and clumps of leaves, to eliminate the need for reprocessing, and to eliminate poor quality, wasteage or increased particulate production.

The traditionally used conditioning system is a simple rigid vacuum chamber into which the tobacco to be treated is placed, the chamber then being evacuated and steam introduced. Such devices, which are exemplified by the Thermo-Vactor chamber or by the VacuDyne system can typically process about 12,000 lbs. of tobacco in about 35 minutes depending on the number of hogsheads for which a particular system is designed, but these devices are costly both in terms of capital investment and steam consumption. Additionally, a considerable direct labor cost is incurred in loading batches of tobacco on pallets and in filling and emptying the chamber, these being the inherent drawbacks of a batch processing system.

Another method that has been used in the prior art is to break the masses of tobacco into smaller pieces and feed them into a revolving steam drum. The combination of agitation and steam conditions the tobacco, but also produces a high level of particulate scrap or fines, i.e. particles of tobacco sufficiently small to pass through a ⅜ inch mesh screen. In addition, the direct labor cost is high, as is steam consumption.

An alternative technique is taught by Philbrick in U.S. Pat. No. 3,124,142, wherein a mass of tobacco is placed within a chamber and a perforated probe is inserted therein. Steam is then introduced into the chamber and a vacuum is connected to the probe so that the steam is gradually drawn through the mass of tobacco and evacuated through the probe, conditioning the tobacco as it passes. This type of equipment is more costly than the simple steam chamber process, however, and uses practically as much steam, even though it does improve the uniformity of conditioning over the steam chamber. In addition to retaining the inherent inefficiencies of batch processing, however, this procedure is not adapted to the processing of small bales of tobacco, and thus is not useful in many applications.

A variation of the probe technique taught in the foregoing patent is shown in U.S. Pat. No. 3,838,698 to Dickenson. In this patent, a tobacco mass is fed into a rectangular chamber, where belt conveyors force it against a probe. Steam is introduced into the space between the back of the chamber and the front of the mass, and a vacuum is applied to the probe, so that the steam is drawn through the front space of the tobacco mass. "Doffers" at the back of the chamber strip off successive layers of tobacco as the mass advances, and the stripped tobacco falls out of an aperture in the chamber floor. The most serious problem with this device is that its output is severely limited for the tobacco mass is said to advance at a rate of 90 mm per minute. Thus, a 30 inch bale would require almost 8 minutes conditioning time, and 45 of the Dickenson devices would be required to match the output of a single Thermo-Vactor chamber. Although speeding up the process would improve productivity, it would also lead to serious particulate problems from the increased stripping action of the doffers.

Attempts have been made to overcome the problems encountered in the steam chamber methods discussed above, including the use of multiple probes for injecting steam into a bale of tobacco. In such devices, the probes are mounted on a horizontal manifold which is lowered onto a bale of tobacco to insert the probe into the bale. Steam is then supplied under pressure into the tobacco bale. The steam continues to flow until the bale is heated and moisturized to the desired degree, and thereafter the probes are removed.

Although such systems are an improvement over prior devices, both from the standpoint of effective conditioning of the tobacco and from the standpoint of cost, a number of problems still remain which have prevented widespread use of the devices. Thus, for example, it was found that when multiple probes are used, it requires a great deal of force to insert all of the probes into the tobacco bale, which is tightly compacted. Further, it was found that in order to avoid unacceptable damage to the tobacco, it was necessary to make the probes of relatively small diameter. But this small diameter, combined with the forces required to insert the probes, often result in the probes bending during attempts to insert them, thus making them unuseable. Further, it was found that the steam would only travel short distances from the probes, and under high pressure would tend to seek the interface between layers of tobacco to escape from the bale, thus producing a nonuniform conditioning of the tobacco. In addition, because of the compactness of the bales once the probes were inserted it was difficult to remove them, for the bales tended to stick to the probes. Thus, rapid operation of these conditioning devices was virtually precluded, and accordingly multiple probe devices have not found acceptance in the industry.

Thus, there exists a need for an improved system for conditioning tobacco at a reduced cost, while retaining the quality of the product at an acceptable level, maintaining or increasing the rate of operation, and keeping a low level of particulates.

SUMMARY OF THE INVENTION

It is, therefore, an object of the present invention to provide an apparatus and a method for conditioning tobacco which will reduce both the acquisition and operating cost of the equipment required while maintaining a high production rate and high product quality. It is a further object of the invention to provide an apparatus and method which will permit conditioning of tobacco at high rates while substantially reducing the production of particulate scrap or fines.

Briefly, the present invention is directed to a tobacco conditioning apparatus which includes a moveable probe assembly having a plurality of spaced, depending, hollow probes arranged in an offset pattern and adapted to be inserted into a compacted mass of tobacco. The probes are elongated tubes of relatively small diameter which are closed at the lower end, but which have a plurality of apertures formed along the lower portion of the side wall. Each probe is flexibly secured to a probe mounting plate so that the probe can flex within a cone having an included angle of approximately 30°, thereby allowing a probe to be inserted into the tobacco mass and to be diverted from its original path without bending. The flexible mounting serves to return the probe to its original position upon withdrawal from the tobacco. The apparatus further includes means for supplying steam under pressure to each probe, the steam exiting through the apertures formed in the probe side walls.

Secured to the probe assembly is a tobacco stripper assembly which is disposed at the lower ends of the probes, the probes extending through corresponding apertures in the stripper. The stripper assembly engages the surface of the tobacco bale as the probes are inserted therein and serves to guide the probes so that the desired pattern of insertion is maintained. A latch mechanism secures the stripper at the surface of the tobacco bale so that when the probes are withdrawn therefrom, the stripper holds the bale in position and prevents it from being lifted by the retracting probes. A release mechanism unlatches the stripper when the probes are substantially completely withdrawn from the bale so that the bale can be removed from the conditioning apparatus and replaced by a bale to be treated.

A suitable conveyor mechanism is provided to index the bales to be conditioned with respect to the probe assembly. In the preferred mode of operation of the invention, the bale is oriented so that the layers of tobacco are arranged vertically on the conveyor and longitudinally with respect to the direction of advancement of the bales through the conditioning apparatus, to facilitate insertion of the probes, to prevent damage to them and to the tobacco, and to reduce the leakage of steam out of the bales along the tobacco layer interfaces.

In operating the foregoing apparatus in accordance with the method of the present invention, a bale of tobacco is positioned under the probe assembly, the assembly is lowered with the stripper until the probes begin to enter the tobacco. At this time, the stripper plate contacts the top of the bale and latches, a position sensitive switch connects a source of high pressure steam to the probes, and steam begins to flow out of the apertures on the lower ends of the probes. As the probes enter the tobacco mass, the steam softens the tobacco to facilitate insertion and to condition the tobacco. The probe assembly moves down to its position of furthest penetration where it dwells for one or two seconds, and then is withdrawn, with steam still being applied under pressure. As the probes are withdrawn from the tobacco mass, the stripper plate is unlatched and is picked up, turning off the steam and completing the cycle. This method of operation permits a very high rate of tobacco conditioning and meets all of the criteria set forth above for both quantity and quality of tobacco conditioning.

BRIEF DESCRIPTION OF THE DRAWINGS

The foregoing and additional objects, features and advantages of the present invention will become apparent to those of skill in the art from a consideration of the following detailed description of preferred embodiments thereof, taken in conjunction with the accompanying drawings, in which.

DESCRIPTION OF PREFERRED EMBODIMENTS

Figure 1:
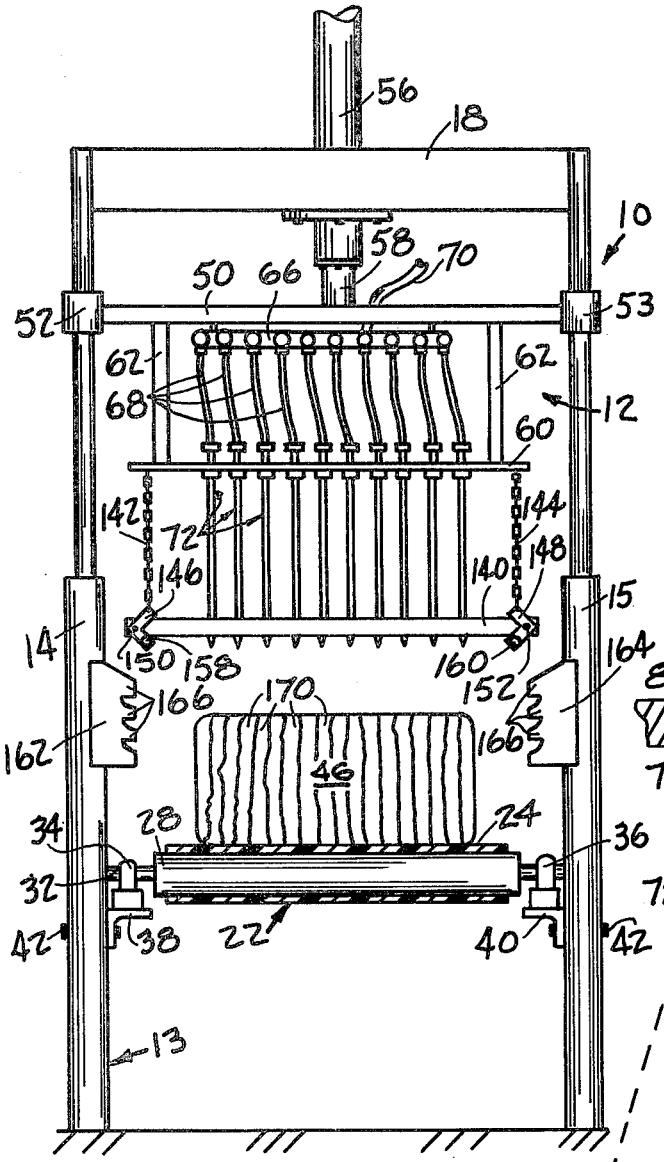
FIG. 1 is a diagrammatic front elevation in partial section along line 1—1 of FIG. 2 of a conditioning apparatus constructed in accordance with the present invention and showing a probe assembly in the "up" or retracted position.
Figure 2:
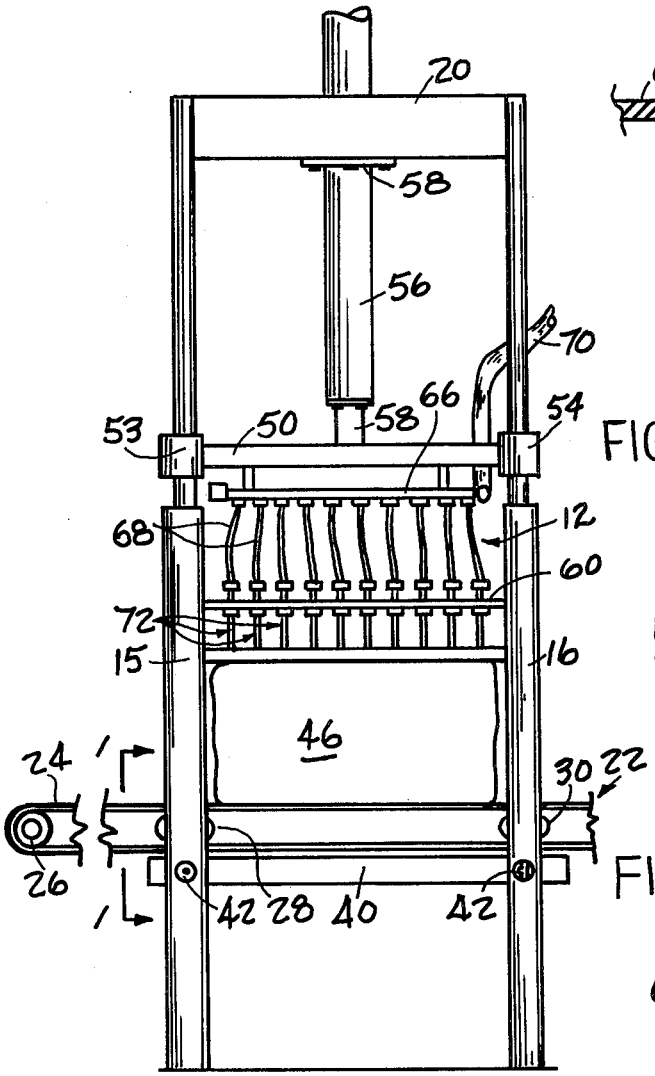
FIG. 2 is a side elevation of the apparatus of FIG. 1, showing the probe assembly in a "down" or extended position.

Turning now to a more detailed consideration of the present invention, there is illustrated in FIGS. 1 and 2 a preferred embodiment of the conditioning apparatus 10 of the present invention. The apparatus illustrates in these figures is particularly useful in conditioning tobacco in leaf form which is contained in small, burlap-wrapped tobacco bales, known as "Turkish bales", and in shipping boxes, called "offshore boxes". It will be understood, however, that the apparatus and method herein described may be adapted to condition other sizes of compacted tobacco masses, such as "large bales" and "hogsheads."

The conditioning apparatus 10 includes a probe assembly 12 mounted for vertical reciprocating motion on a suitable support frame 13 which may take many forms, but for purposes of illustration includes vertical support legs 14, 15, 16 and 17 (not shown). These legs form the corners of the support frame 13 and are joined at the top by horizontal cross members illustrated at 18 and 20, with additional braces (not shown) being used as required to provide the desired rigidity to the frame. Although an enclosure for frame 13 is not essential to the operation of conditioning apparatus 10, it may be found desirable to locate suitable enclosure walls around the probe assembly and the area of the conveyor (to be described) where the conditioning operation takes place in order to trap steam which might escape from the bale, and to reduce the amount of particulate material in the atmosphere.

Mounted near the base of the support frame legs 14, 15, 16 and 17 is a conveyor assembly 22, which may be of any convenient design, but preferably is a belt-type conveyor which includes a belt 24 carried by a plurality of rollers 26, 28 and 30. As illustrated in FIG. 1 wherein the conveyor is shown in a partial section taken along line 1—1 of FIG. 2, the roller 28 may include a shaft 32 journalled at each end in corresponding pillow blocks 34 and 36 mounted on corresponding angle brackets 38 and 40. The angle bracket 38 extends between vertical legs 14 and 17 and bracket 36 extends between vertical frame legs 15 and 16, the brackets being secured to the respective legs by suitable bolts 42, by welding, or by other suitable fastening means. The brackets 38 and 40 and the conveyor assembly 22 define a longitudinal direction through the conditioning apparatus 10.

The conveyor roller 30 may be mounted on brackets 38 and 40 in the manner illustrated for roller 28, while roller 26 may be a drive roller for the conveyor and thus suitably mounted for this purpose and connected to a drive mechanism (not shown).

The drive mechanism for the conveyor is operated to transport compacted tobacco bales or boxes 46 into the support frame 13 and to position them vertically beneath the probe assembly 12 for conditioning of the tobacco. The probe assembly is then driven downwardly to insert a plurality of probes into the bale, and steam is released to condition the tobacco. The probe assembly is then lifted, the conditioned bale is moved to the next processing step, and another bale is positioned under the probe assembly. The control mechanism for indexing the tobacco bales in and out of the conditioning apparatus is not shown, but will be understood to include conventional sensing means and control circuits responsive to the completion of the conditioning cycle by the probe assembly to activate the conveyor to move the bales and thereafter again to activate the probe assembly.

The probe assembly 12 includes a main support plate 50 which is generally rectangular in shape and is mounted for vertical motion within the frame assembly 13. In one form of the invention, the main support plate 50 may be fastened at its four corners to suitable sleeve bearings 52, 53, 54 and 55 (not shown) mounted on corresponding support legs 14, 15, 16 and 17. The sleeve bearings guide the support plate in its vertical motion between the "up", or retracted position illustrated in FIG. 1, and the "down", or extended position illustrated in FIG. 2. The support plate 50 may be fabricated from any suitable material, and may be a solid plate or may be an open framework, as desired.

Reciprocation of the probe assembly is effected by means of a ram 56, secured in a suitable journal 58 mounted within the horizontal frame members 18, 20 of the assembly support frame. The ram 56 is driven by a suitable power source such as an hydraulic cylinder (not shown) and is controlled to drive the probe assembly vertically downwardly and upwardly between the positions shown in FIGS. 1 and 2. The ram 56 is secured to the probe assembly support plate 50 in any suitable manner, as by means of a connecting stub 58 which may be welded or bolted to the support plate 50 at one end and to the ram 56 at the other end.

Secured below and spaced from the support plate 50 is a generally rectangular probe mounting plate 60 which is supported by means of vertical mounting arms 62. Although only two mounting arms are illustrated in FIG. 1, it will be understood that any number of such arms may be provided to maintain the desired relationship between plates 50 and 60, and in a preferred form, four such mounting arms would be provided at the four corners of the mounting plate 60.

Secured to the undersurface of the support plate 50, within the space between plate 50 and 60, is a steam header 66 to which is connected a plurality of flexible feed lines 68 which serve to connect the header to the tobacco treatment probes to be described. Saturated steam under pressure is supplied from a source (not shown) to the header 66 by way of a steam line 70, which preferably is also flexible to accommodate the motion of the probe assembly. In one embodiment of the invention, steam is supplied at 150 psig at 365° F., although other values may be used, depending upon the tobacco mass being conditioned.

The probe mounting plate 60 carries a plurality of individual tobacco conditioning probes 72 arranged in a pattern designed to produce optimum conditioning of the tobacco in bale 46. As illustrated in greater detail in FIGS. 3–8, each probe is flexibly mounted in the mounting plate 60, but is held parallel relationship with adjacent probes by suitable biasing means such as springs. The flexible mounting of the probes allows each probe to deviate slightly from its normal vertical orientation as it is inserted into the tobacco, thus preventing bending of the probes, and allowing the probes to be thinner than would otherwise be required. Bending of the probes has been found to be a particular problem for probes which enter near the edges of the bales, although bending can also occur in other areas.

Figure 3:
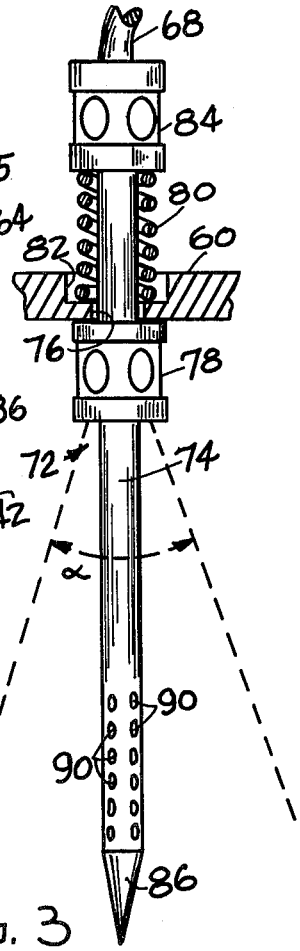
FIG. 3 is a partial sectional view of a probe suitable for use in the probe assembly of FIG. 1.

One arrangement for flexibly mounting the probes 72 is illustrated in FIG. 3. The probe consists of a tubular probe body 74 extending through an aperture 76 in mounting plate 60, the interior diameter of aperture 76 in mounting plate 60, the interior diameter of aperture 76 being larger than the exterior diameter of probe body 74 to permit the probe to tilt away from the perpendicular. The probe body is positioned in the plate 60 by means of a lower collar 78 which may be welded or otherwise fastened to the exterior surface of tube 74. The collar is biased upwardly against the lower surface of plate 60 by means of a coil spring 80, the lower end of which is located in a countersunk mounting aperture 82 formed in the upper surface of plate 60. The upper end of the spring abuts an upper collar 84 mounted on the upper end of probe body 74. Collar 84 is in the form of a fitting which joins the tubular probe body 74 to a corresponding one of the flexible connectors 68, whereby the probe is connected the steam header 66.

As previously noted, the mounting aperture 76 is larger than the diameter of the probe body 74 so that a transverse force against the probe body, for example, at the tip 86, will result in the tilting of the probe body within the aperture. The aperture is sufficiently large to allow the probe body to move within a cone defined by the angle $\alpha$ which may be, for example, about 30°. Tilting of the probe body compresses one side of the coil spring 80, so that when the transverse force on the tip is released, the spring forces the probe back to a vertical position.

The probe body may be constructed from a variety of materials, but in the preferred form the body is constructed of thin stainless steel tubing with a ½ inch outside diameter, the tube extending approximately 16 inches below the mounting plate 60. The probe tip 86 may be about 1 inch long and includes a flange which is inserted into the tubular body 74, with the tube being soldered or otherwise secured to the probe body. A series of openings 90 are formed in the probe body to provide an exit for pressurized steam from the header 66. In the preferred form of the invention, the holes are 1/16 inch in diameter and are spaced axially one inch apart in 3 longitudinally extended rows of 6 holes each, with the rows being circumferentially spaced 120°, resulting in a total of 18 holes for the probe.

Although the probe body 74 is illustrated in FIG. 3 as extending through the aperture 76 and terminating in fitting 84, it should be understood that alternative structures can be used. Thus, for example, the collar 78 may be a fitting which threadedly engages the lower portion of probe body 74, with the upper portion being a separate tubular connection extending between and threadedly engaging, collars 78 and 84. Further, although the flexible mounting of FIG. 3 is preferred, a variety of other flexible mountings can be provided, as illustrated in FIGS. 4–8. In the FIG. 4 embodiment, the probe body 74 is mounted to a fitting 92 which in turn is mounted on a spring 94 secured to mounting plate 60. The spring 94 holds the probe body in a vertical position, but allows motion away from the vertical in the manner described with respect to FIG. 3. Steam is supplied to the probe body by way of the flexible steam line 68, which is connected to fitting 92.

Figure 4:
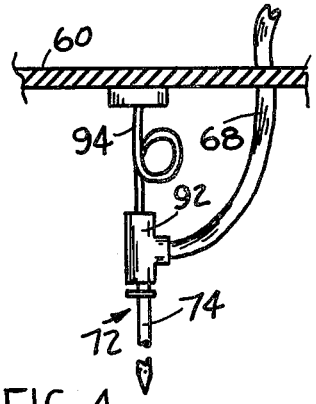
FIGS. 4–8 are modifications of the probe assembly of FIG. 3.
Figure 5:
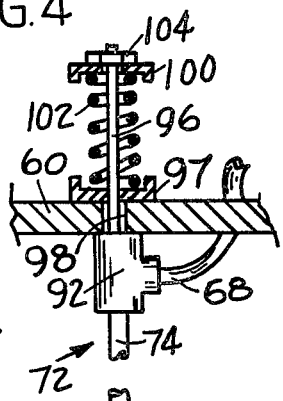

Another form of flexible mounting for the probe 72 is illustrated in FIG. 5, wherein the probe body 74 is mounted on the steam fitting 92, in the manner of FIG. 4. However, in this arrangement the fitting 92 is secured to a support rod 96 which extends through an aperture 98 in the mounting plate 60, the support rod carrying a pair of opposed dish-shaped washers 97 and 100 between which extends a coil spring 102. The spring is coaxial with rod 96 and is held in position by the washers 98 and 100, the spring being compressed by means of a nut 104 threaded onto the upper end of rod 96 and abutting the upper washer 100. As with the device of FIG. 3, a transverse force on the probe body 74 will cause the rod 96 to move away from the vertical to compress the spring 102, so that upon release of the transverse force, the spring will return the probe to its vertical position.

Figure 6:
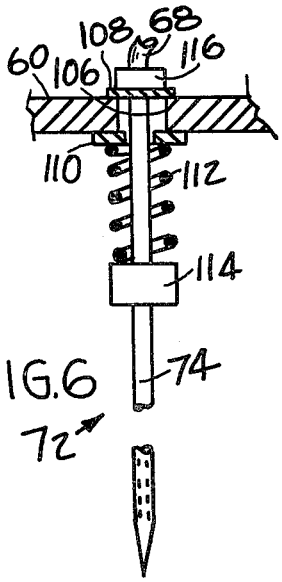

Another embodiment of the invention is illustrated in FIG. 6 wherein the probe body 74 extends through an aperture 106 in mounting plate 60, the aperture again being sufficiently large to allow a tilting motion of the probe body 74 in response to transverse forces. The probe body is mounted in aperture 106 by means of upper and lower washers 108 and 110 which are secured on opposite sides of plate 60 by the bias pressure exerted by coil spring 112. The spring is coaxial with the probe body 74, with its upper end abutting washer 110 and its lower end abutting a collar 114 mounted on the probe body. A fitting 116, which is connected to the upper end of the probe body 74 and abuts the top surface of washer 108, connects the flexible steam line 68 to the probe body 74 in the manner previously discussed.

Figure 7:
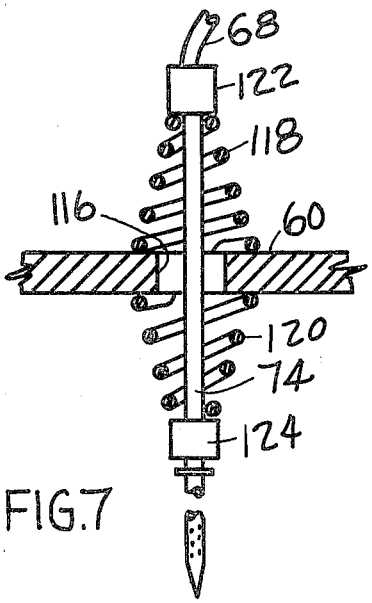

A still further modification of the flexible probe mounting is illustrated in FIG. 7 wherein the probe body 74 is secured within an aperture 116 in mounting plate 60 by means of a pair of opposed coil springs 118 and 120. The springs are coaxial with the probe body, but are located on opposite sides of mounting plate 60, with the outer ends of the coils abutting fitting 122 and collar 124, respectively. As before, fitting 122 serves to connect the flexible steam line 68 to the probe body 74.

Figure 8:
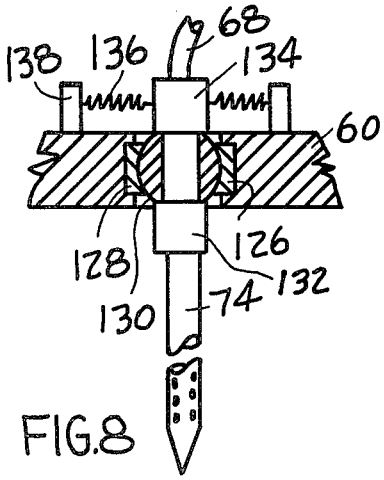

The embodiment of FIG. 8 illustrates a flexible mounting for probe body 74 which incorporates a ball and socket mounting within an aperture 126 formed in the mounting plate 60. A socket portion 128 is secured in aperture 126 and receives a ball 130 which is mounted on the probe body 74. The ball is positioned on the probe by a lower collar 132 and an upper fitting 134 which serves to connect the flexible steam line 68 to the probe body 74. The ball and socket arrangement allows the probe body to be deflected from its normal vertical position by transverse forces, as described above, with the probe being returned to its vertical position by means of three coil springs connected at three spaced locations around the fitting 134. As illustrated by spring 136, each of the springs is connected between the fitting 134 and a corresponding stud 138 to provide a horizontal biasing tension to the top of the probe body, whereby the body will be returned to its normal vertical position after deflection. The studs 138 and springs 136 are spaced 120° apart around the axis of probe body 74.

Returning now to FIGS. 1 and 2, the probes 72 depend downwardly from the mounting plate 60 with their lower ends extending through a horizontal, generally retangular stripper plate 140 suspended below the mounting plate 60 by means of chains 142 and 144 at the front edge of the stripper plate 60, as viewed in FIG. 1, and similar chains (not shown) at the rear edge of the stripper plate. Plate 140 may be wood or other suitable material, and includes a plurality of apertures each located directly below a corresponding probe location and adapted to receive that probe, and each being of larger diameter than the corresponding probe body to permit some transverse motion of the corresponding probes.

Figure 9:
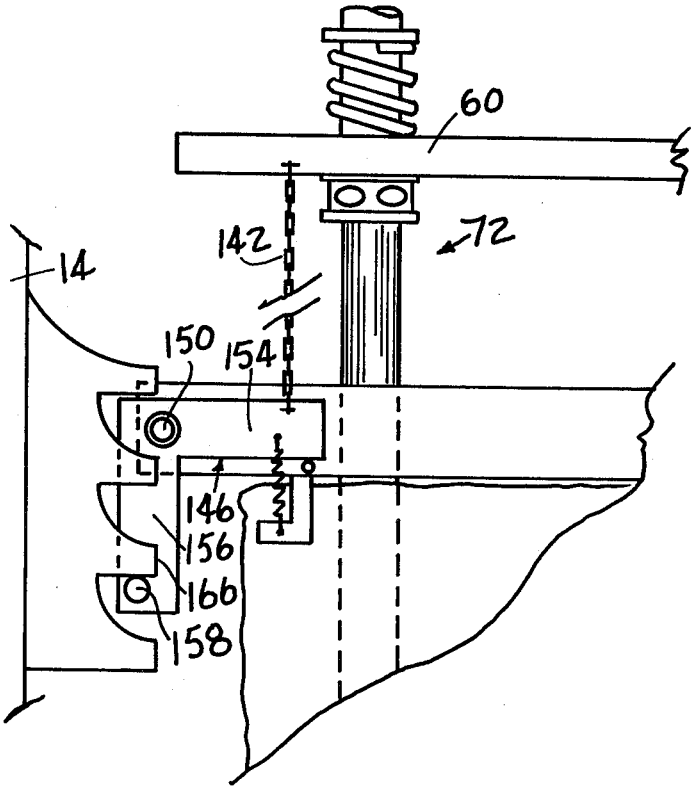
FIG. 9 is an enlarged view of the latch arrangement used with the stripper plate of the probe assembly.

The lower ends of flexible chains 142 and 144 are connected to the stripper plate by means of pivoting latches 146 and 148, respectively, which are shown in greater detail in FIG. 9. The latches 146 and 148 are pivotally mounted on the stripper plate 140 by means of suitable pivot pins 150 and 152, respectively, so that the latches are freely pivotable. In its preferred form, each latch is generally L-shaped with one leg being connected to the lower end of the corresponding support chain, and the other leg carrying a latch pin. Thus, for example, the latch 146 includes an upper leg 154 (FIG. 9) connected to the lower end of chain 142, and a lower leg 156 carrying a latch pin 158. The latch 148 is similarly constructed, having one leg connected to the lower end of clain 144 and the other leg carrying a latch pin 160.

When the probe assembly 12 is in the retracted position illustrated in FIG. 1, chains 142 and 144 support the horizontal stripper plate 140 near the lower ends of probe 72, the stripper plate being supported by means of the latches 146 and 148 and the corresponding pivot pins 150 and 152 mounted at the corners of the stripper plate and by similar latches and chains at the rear corners thereof. The latches 146 and 148 are pivoted by the weight of the stripper plate to the positions generally indicated in FIG. 1 so that the latch pins 158 and 160 are positioned inwardly of the corresponding pivots pins 150 and 152 when the stripper plate is retracted.

When the probe assembly is driven downwardly by the ram 56 toward the tobacco bale 46, the stripper plate 140 strikes the top of the bale at about the same time as the tips of probes 72 enter the tobacco. The stripper plate remains on the top of the bale, but the probe assembly continues to move downwardly to cause the probes to pass through the stripper and into the tobacco. This causes the support chains 142 and 144 to become slack, causing the latches 146 and 148 to pivot their latch pins 158 and 160 outwardly into engagement with corresponding ratchet assemblies 162 and 164 mounted adjacent the path of the stripper plate. The ratchet assemblies conveniently may be secured to the inside surfaces of frame members 14 and 15. It will be understood that similar ratchet assemblies are provided on frame members 16 and 17 to receive the latches mounted on the remaining corners at the rear edge of the stripper plate. Each rachet assembly includes several vertically spaced teeth 166, each tooth has a sloped upper side and a horizontal lower side (see FIG. 9). The number of teeth and their exact location on the vertical frame member 14 to 17 are determined by the height range of the tobacco masses to be conditioned, since it is necessary to locate the teeth at approximately the same level as the top of the tobacco mass so that the latches can engage the ratchet assembiles.

As illustrated in FIG. 9, when the chain 142 slackens, the latch 146 is released and pivots in a clockwise direction to cause the latch pin 158 to engage one of the teeth 166, the particular tooth engaged depending upon the exact height of the tobacco mass 46. In similar manner, the latch pin 160 engages one of the teeth on racket assembly 164 and similar latches engage similar rachets on the remaining corners of the stripper plate 140.

When the probe assembly is retracted to pull the probes 72 out of the tobacco 46, the stripper plate 140 initially remains in engagement with the top surface of the tobacco, it being held in position by the latches 146 and 148. Continued retraction of the probe assembly pulls the probe upwardly through the apertures in plate 140 so that the plate strips the tobacco from the probes, thus preventing the tobacco mass from being picked up by the probe assembly. As the probe tips reach the level of the stripper plate, the upward motion of probe mounting plate 60 takes up the slack in chains 142 and 144. The chains start to pick up plate 140 by means of latches 146 and 148, causing the latches to pivot and to move the latch pins 158 and 160 inwardly, thereby disengaging them from the ratchet assembly teeth. Continued upward motion of the mounting plate 60 then lifts the stripper plate 140 clear of the bale 146 so that the bale may be indexed out of the conditioning apparatus.

Although FIGS. 1 and 2 illustrate a single bale at a time being processed in the conditioning apparatus 10, it will be apparent that in practice the conveyor 22 will carry a series of bales abutted end to end. The series of bales is advanced through the conditioning apparatus in an intermittent indexing motion, with the conveyor periodically advancing by a distance approximately equal to the length of the conditioning apparatus. Since the length of the bales may vary, this indexing may result in the apparatus conditioning a part of a bale, or parts of two adjacent bales, rather than the single bale illustrated. However, the motion of the conveyor during indexing moves the treated portion of the bale or bales out of the conditioning apparatus at the completion of a treating cycle, and moves an untreated portion of a bale or bales index the probe assembly. Thus, the probe assembly may span across two bales during a conditioning operation.

Figure 10:
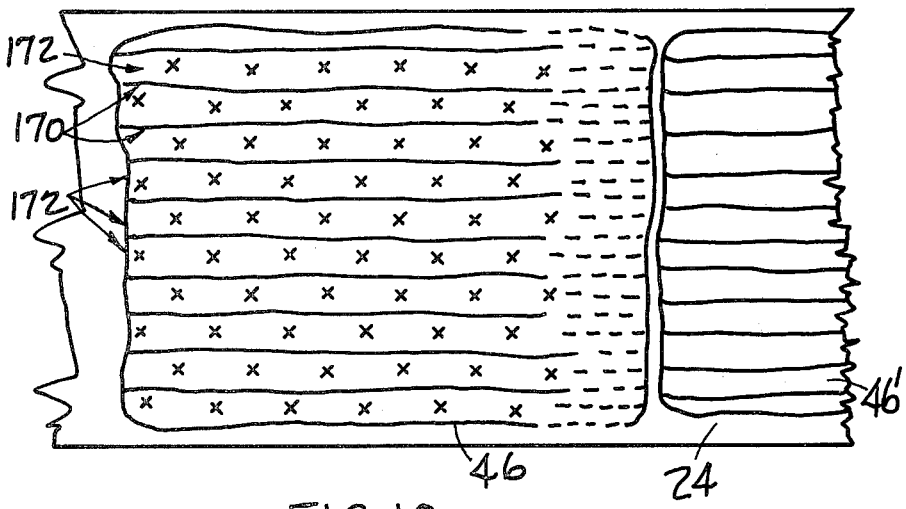
FIG. 10 illustrates a preferred pattern for the probes of the probe assembly of FIG. 1.

As illustrated in FIGS. 1 and 10, the tobacco bale 146 is arranged on the conveyor 22 in such a way that the "layers" of tobacco, which are formed as the bale is packed, extend vertically and longitudinally, as indicated by the layer interface lines 170. By orienting the layers longitudinally of the direction of travel on the conveyor, the bending of probes particularly those near the leading or trailing edges of the bale or of adjacent bales, is avoided.

Also illustrated in FIG. 10, which is a plan view of the bale 46, is the offset grid pattern formed by the array of probes 72 as they are mounted on plate 60, the "x" marks indicating where the probe bodies 74 will enter the bale when the probe assembly is lowered. By arranging the probes in longitudinal rows 172 with adjacent rows being offset, it was found that the tobacco in bale 46 is more uniformly conditioned and that there is less leakage of steam along the interfaces 170 between layers than occurred with the probes arranged in both transverse and longitudinal rows. Offsetting one row by a distance equal to one half the distance between adjacent probes was found to give the most uniform distribution of steam.

In the preferred array of probes, ten rows of ten probes each are used, with the distance between adjacent rows and between adjacent probes in a row being approximately three inches, and the offset being $1\frac{1}{2}$ inches. But it should be understood that the particular array shall be determined by the type of mass being processed and the process weight/time ratio required for the particular mass. It should be noted that although the layer interfaces 170 are shown for purposes of illustration as falling between adjacent rows of probes, the layers are not necessarily of equal width, nor are they necessarily evenly spaced across the width of the bale. Thus, some of the probes may strike a given bale in one of the layers and other probes may strike interfaces between layers, while other layers may be missed entirely. However, with the arrangement or probes illustrated in FIG. 10, it has been found that a relatively uniform steam penetration is provided and thus the illustrated array is preferred.

In the operation of the conditioning apparatus of the present invention, bales to be conditioned are loaded onto the conveyor 22 with adjacent bales firmly abutted together and with their sides aligned with one side of the conveyor; for example, the left side of the conveyor 22 as viewed in FIG. 1. When a first bale to be conditioned is carried under the probe assembly by the conveyor, automatic cycling is initiated by means of suitable control circuitry (not shown). For example, switch means may be provided to respond to the position of the bale so that when the bale is under the probe assembly, conveyor 22 is stopped and the operation of ram 56 is started, to drive the probes 72 downwardly toward the bale 76. When the stripper plate 140 contacts the top of bale 46, a sensor is activated and high pressure steam is applied by way of input line 70 to the steam manifold 66 and then by way of flexible lines 68 to the probes 72. The flow of steam may be activated by a microswitch responsive to the lowering of the stripper plate, by photoelectric means which sense the location of the stripper plate, or by other suitable control devices.

After the steam is turned on, the ram continues to drive the probe assembly downwardly, forcing the probes into the compressed tobacco mass within bale 46, the steam flowing out of the lower portions of the probes by way of apertures 90 to condition the tobacco as the assembly moves downwardly. The probe assembly is driven downwardly until the tips of the probes approach to within approximately ½ inch of the bottom of the bale, at which time the probe assembly stops. The probe dwells at the bottom of its downward stroke for about one or two seconds, then the ram 56 is reversed to withdraw the probes upwardly and out of the bale. As previously indicated, when the stripper plate 140 contacts the top of bale 46 on the downward stroke, the latches 146 and 148 engage corresponding teeth on pawls 162 and 164 so that during the upward stroke, when the probes are being retracted from the bale, the stripper plate is secured in position and prevents the bale from being lifted by the probes. As the probes leave the bale, the chains 142 and 144 disengage the latches and at the same time the high pressure steam supply is turned off. Thereafter, the conveyor 22 indexes a distance equal to the length of the probe assembly 12 to carry an unconditioned bale or portion thereof under the probe assembly, at which time another cycle is initiated.

Figure 11:
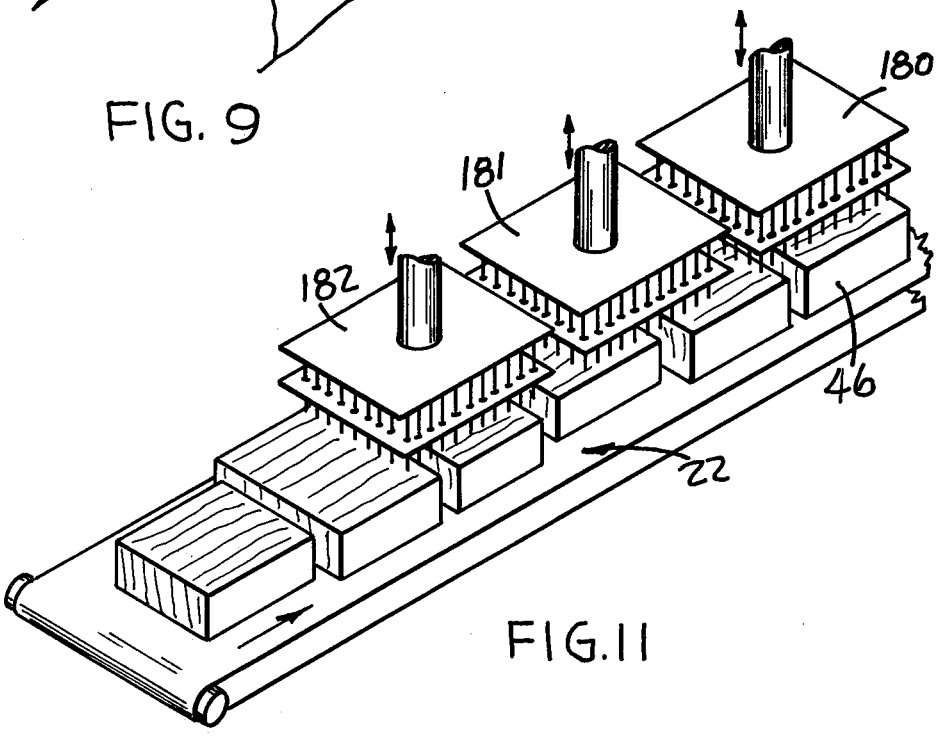
FIG. 11 is a perspective view in diagrammatic form of a conditioning system in accordance with the present invention.

Although FIGS. 1 and 2 show a conditioning apparatus having a single probe assembly, it will be apparent that several probe assemblies could be ganged together to increase production in the manner illustrated in diagrammatic form in FIG. 11. Thus, a series of three probe assemblies 180, 181 and 182, each constructed in the manner illustrated with respect to FIGS. 1 and 2, can be aligned longitudinally along the conveyor 22 so that a large number of bales 46 can be conditioned in one operation. In this case, all three of the probe assemblies would be operated at the same time to condition the bales positioned thereunder, and upon retraction of the probes the conveyor 22 would be indexed a distance equal to the total length of the three assemblies. This arrangement has the advantage that a single bale need not be aligned with a particular probe assembly, but each assembly can span across one or more bales depending on the size of the bales. Furthermore, a practical production speed can be achieved, since additional probe assemblies can be added at will.

In order to accommodate bales of varying sizes, it may also be desirable to provide a series of cut-off valves (not shown) either in the steam manifold 66 or in selected rows of the flexible steam line 68 so that, for example, if the probe assembly is wider than the bale, one or more rows of probes can be turned off during the conditioning operation to prevent loss of steam. This can be accomplished by means of separate steam header for the outermost rows of probes, for example, with each of the headers being controlled by a separate valve in accordance with the width of the bales being conditioned. Sensors which detect the width of the bales can be used to activate such valves as required. Alternatively, integral valves may be incorporated in the shank of each probe to open only upon insertion of that probe into a bale.

Although the present invention has been described in terms of preferred embodiments, it will be understood that numerous variations in the illustrated apparatus and in the methods for conditioning the tobacco are possible within the scope of the prevent invention. Thus, for example, longer probes or pairs or probes in opposition, can be used for larger bales and hogsheads, or for even larger masses, a portion of the bale can be treated, the conditioned tobacco raked off, and the remainder treated. Furthermore, it will be apparent that instead of injecting steam into the tobacco, other process liquids or gases may be injected into the bale.

Although the described sequence for applying steam to the tobacco mass is preferred, it will be understood that other cyclical patterns can be used. Thus, for example, it may be possible to insert the probes while supplying steam under low pressure to soften the tobacco as the probe advances, and when the downward limit of the probe assembly is reached, high pressure steam may then be supplied for a period of time sufficient to condition the tobacco. However, such an arrangement requires steam exit apertures along the entire length of the probe, and is less satisfactory then the process described hereinabove.

The apparatus of the present invention optimizes the conditioning process so that a high production volume can be obtained at substantially reduced costs and with lower steam consumption, lower particulate levels, and with a high degree of uniformity. Thus, it is desired that the true spirit and scope of the invention be limited only by the following claims:

What is claimed is:

1. Apparatus for conditioning a tobacco mass, comprising:

a probe assembly including a multiplicity of parallel, hollow, perforated probes; and means for flexibly mounting said probes to prevent bending of said probes upon insertion into said tobacco mass;

means for mounting said assembly for reciprocating motion along a path between a normal retracted position and an extended position;

means for transporting a tobacco mass into the path of said assembly;

means driving said assembly along said path from said retracted position to said extended position to insert said probes into said tobacco mass and from said extended position back to said retracted position to extract said probes from said tobacco mass; and means for conducting tobacco conditioning fluid to said hollow probes for conditioning the tobacco mass.

2. The apparatus of claim 1, wherein each of said probes comprises a thin-walled, elongated tube having a tapered tip portion closing its lower end, and a plurality of perforations formed in a spaced array around the lower portion of said tube.

3. The apparatus in claim 1, wherein said probe assembly further includes stripper means supported to surround the lower portions of said probes, said stripper means serving to strip said tobacco mass from said probes during extraction of the probe from said mass.

4. The apparatus of claim 3, wherein said stripper means comprises a stripper plate supported below and parallel a probe mounting plate, said stripper plate having a plurality of apertures corresponding to and through which said probes extend, each said stripper plate aperture being larger in diameter than the diameter of its corresponding probe, whereby said probes can move freely through said stripper plate.

5. The apparatus of claim 4, wherein said stripper plate further includes latch means for securing said plate on the surface of said tobacco mass during the insertion and extraction of said probes from said mass, and means for releasing said latch means as the probes leave said mass.

6. The apparatus in claim 5, wherein said latch means comprises a plurality of brackets pivotally mounted on said stripper plate, each of said brackets including a latch pin adapted to engage a corresponding ratchet assembly mounted adjacent path of said probe assembly.

7. The apparatus of claim 6, wherein said stripper plate is supported below said probe mounting plate by means of flexible lines connected to said pivotally mounted latch brackets, said flexible lines being under tension to support said stripper plate when said probe assembly is retracted, the tension in said flexible lines causing said latch brackets to pivot to a non-latching position, and said flexible lines being slack when said probe assembly inserts said probes into a tobacco mass, the slackening of said flexible lines allowing said latch brackets to pivot to a latching position.

8. The apparatus of claim 7, wherein said latch bracket has two legs arranged in an L-shape, a first leg carrying said latch pin and a second leg being connected to said flexible line.

9. The apparatus of claim 7, wherein said flexible line is a chain.

10. The apparatus of claim 1, wherein said probe assembly further includes a probe mounting plate for carrying said probes.

11. The apparatus of claim 10, wherein said bending prevention means includes, for each of said probes, means for allowing said probe to tilt upon application to said probe of a force transverse to the axis thereof, and biasing means for restoring said probe to its initial position upon removal of the transverse force.

12. The apparatus of claim 10, wherein said bending prevention means for each said probe includes an aperture in said mounting plate, said aperture being of greater diameter than the diameter of said probe, and means for resiliently securing said probe in said aperture.

13. The apparatus of claim 1, wherein said probes are arranged in rows, adjacent said rows being offset from one another by a selected distance.

14. The apparatus of claim 13, wherein said selected distance equals about one-half the distance between adjacent individual probes.

15. A method for conditioning a compacted tobacco mass, comprising:

aligning a mass of tobacco to be conditioned with a movable probe assembly wherein said probe assembly is flexibly mounted to prevent bending of said probe assembly upon insertion into said tobacco mass;

extending said probe assembly to insert a plurality of spaced, parallel, flexibly-mounted probes into said tobacco mass;

supplying steam under pressure to said probes as said probes enter said tobacco mass, said steam exiting from apertures at the bottom portions of said probes;

advancing said probes substantially through said tobacco mass and thereafter retracting said probes from said tobacco mass while continuously supplying steam thereto; and withdrawing said probes from said tobacco mass and cutting off said supply of steam.

16. The method of claim 15, wherein said probes dwell in said tobacco mass before being retracted, whereby said tobacco mass is uniformly conditioned.

17. The method of claim 16, further including stripping said tobacco mass from said probes during retraction thereof.

18. The method of claim 17, wherein the step of aligning a mass of tobacco comprises:

arranging a compacted mass of tobacco on a conveyor in such a way that the interfaces between layers of tobacco are oriented to be substantially parallel with said probes and with the direction of mortion of said conveyor; and indexing said the mass of tobacco to be treated into alignment with the probe assembly.

* * * * *